US005693912A

United States Patent [19]

Tien et al.

[11] Patent Number: 5,693,912

[45] Date of Patent: Dec. 2, 1997

[54] LOW PROFILE INTERCONNECT FOR A SEGMENTED ELECTRODE DONOR ROLL AND A COMMUTATOR

[75] Inventors: Paul C. Tien, Torrance; Sousanna Kardashian, Glendale, both of Calif.; Mohammad M. Mojarradi, Pullman, Wash.; Tuan A. Vo, Hawthorne, Calif.; Charles E. Morand, Claremont, Calif.; Charles C. Currie, Chatsworth, Calif.

[73] Assignee: Xerox Corporation, Stamford, Conn.

[21] Appl. No.: 673,874

[22] Filed: Jul. 2, 1996

[51] Int. Cl.[6] ..... H01B 7/02

[52] U.S. Cl. ..... 174/68.1

[58] Field of Search ..... 399/266, 285; 174/68.1, 29

[56] References Cited

U.S. PATENT DOCUMENTS 3,487,249 12/1969 Nicholls et al. ..... 310/237

*Primary Examiner*—Kristine L. Kincaid
*Assistant Examiner*—Dhiru R. Patel
*Attorney, Agent, or Firm*—Nola Mae McBain

[57] ABSTRACT

A low profile interconnect is used for electronic connections to segmented electrode donor rolls in which at least 78 interconnections between the segmented donor roll and a commutator can be made with a profile of approximately 10–15 mils, which retains reliability in an approximately 600 rpm rotational environment and which withstands 2000 volts between adjacent lines.

6 Claims, 3 Drawing Sheets

LOW PROFILE INTERCONNECT FOR A SEGMENTED ELECTRODE DONOR ROLL AND A COMMUTATOR

BACKGROUND

This invention relates generally to electronic connections to segmented electrode donor rolls and more particularly concerns a low profile interconnect in which at least 78 interconnections between the segmented donor roll and a commutator can be made with a profile of approximately 10–15 mils, which retains reliability in an approximately 600 rpm rotational environment and which withstands 2000 volts between adjacent lines.

A segmented electrode donor roll (SED) requires a large number of electronic interconnects between the SED and it's controlling electronics or commutator. The number of interconnects needed will depend upon the grouping or ganging of individual electrodes on the SED and can easily vary from 78 to 312 connections with current configurations of SEDs. The corresponding pitch sizes are from 20 mils to 5 mils with corresponding interconnect widths from 20 mils to 5 mils if the interconnect is fabricated to fit within the SED profile and maintain clearance to the photoreceptor.

Accordingly, it is the primary aim of the invention to fabricate a low profile interconnect in which at least 78 interconnections can be made with a profile of approximately 10–15 mils, which retains reliability in an approximately 600 rpm rotational environment and which withstands 2000 volts between adjacent lines.

Further advantages of the invention will become apparent as the following description proceeds.

SUMMARY OF THE INVENTION

Briefly stated and in accordance with the present invention, there is provided a low profile interconnect disk comprised of 3 disks made from an insulating material Each disk has a center, a center hole, and a circumferential edge. On each disk is a multiplicity of conductive through-holes and an equal number of conductive grooves. Each conductive through-hole has a corresponding conductive groove, and the conductive through-holes are arranged around the center hole, while the conductive grooves are arranged on the circumferential edge. The conductive through-holes and grooves on each disk are arranged such that they align with said multiplicity of conductive through-holes and grooves on the other disks. Two of the disks have a multiplicity of conductive lines. The number of conductive lines on both disks equals the number of conductive through-holes with their corresponding conductive grooves. Each line of the multiplicity of conductive lines on each disk is used to connect one conductive through-hole with it's corresponding conductive groove. The conductive lines on both disks are further arranged such that each conductive through-hole is connected only with it's corresponding conductive groove.

Figure 1:
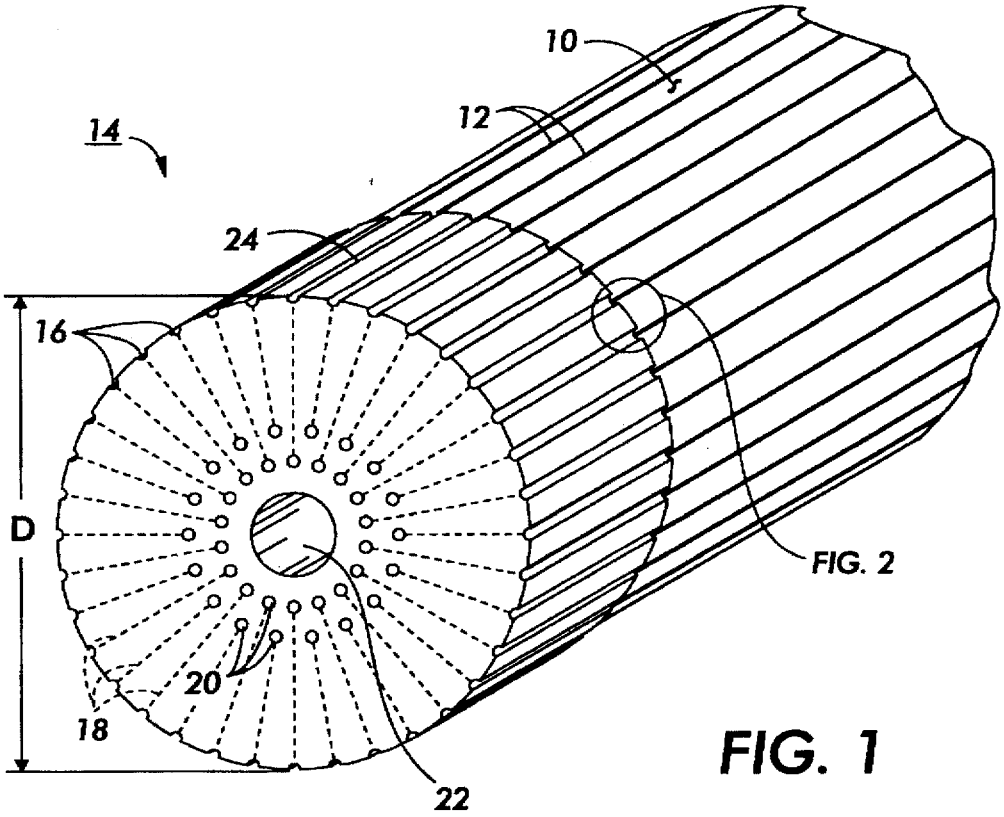
FIG. 1 shows a perspective view of an interconnect disk mounted on a segmented electrode donor roll.

While the present invention will be described in connection with a preferred embodiment and method of use, it will be understood that it is not intended to limit the invention to that embodiment or procedure. On the contrary, it is intended to cover all alternatives, modifications and equivalents as may be included within the spirit and scope of the invention as defined by the appended claims.

ALPHA-NUMERIC LIST OF ELEMENTS

D diameter
10 segmented electrode donor roll
12 segmented electrode donor roll electrodes
14 interconnect disk
16 conductively coated channels
18 interconnect lines
20 interconnect holes
22 central mounting hole
24 conductive coating
25 bead of conductive epoxy
26 top insulative layer
27 wiring layer
28 middle insulative layer
29 wiring layer
30 bottom insulative layer
32 printed wiring board

DETAILED DESCRIPTION OF THE INVENTION

Turning now to FIG. 1 a perspective view of an interconnect disk 14 mounted on a segmented electrode donor roll 10 is shown. The interconnect disk 14 has an approximate diameter of 2 inches. The segmented electrode donor roll 10 has a plurality of segmented electrode donor roll electrodes 12 that control a toner cloud. For detailed information on the construction and operation of segmented electrode donor rolls please consult U.S. Pat. No. 5,360,940 titled Scavengeless Two Component Development with an Electroded Development Roll by Hays which is herein incorporated by reference. It is these segmented electrode donor roll electrodes 12 that must be connected to a commutator or controlling electronics (not shown) through the interconnect disk 14.

The interconnect disk 14 has a series of channels 16 around the perimeter that align with the segmented electrode donor roll electrodes 12. Each of the channels 16 is coated with a conductive coating 24. This coating can be a variety of coatings including conductive epoxies and metals. An electronic connection is made between the conductive coating 24 in the channels 16 and the segmented electrode donor roll electrodes 12 by using a bead of conductive epoxy 25 such as Epoxy Technology Incorporated's B-9126A which is a single component silver-filled epoxy although other conductive epoxies could also easily be used such as Ablestik Ablebond 16-1LV low temperature cure epoxy adhesive. The requirements for the epoxy are that it have a low curing temperature of no more than approximately 65 degrees centigrade and that it also have a low sheet resistance of no more than approximately 10 ohms per square. This feature is more clearly shown in FIG. 2 which is an enlarged view of a portion of FIG. 1 in the area that the connection is made between the conductive coating 24 in the channels 16 and the segmented electrode donor roll electrodes 12.

The face of the interconnect disk 14 has a series of plated interconnect through holes 20 which are conductive. Electronic connections between the commutator or controlling electronics (not shown) and the interconnect disk 14 are made through these interconnect through holes 20. The interconnect through holes 20 are connected to the channels coated with the conductive coating 24 by a series of interconnect lines 18. A single interconnect line 18 electrically connects a single interconnect through hole 20 to a single channel 16 and its conductive coating 24.

Figure 2:
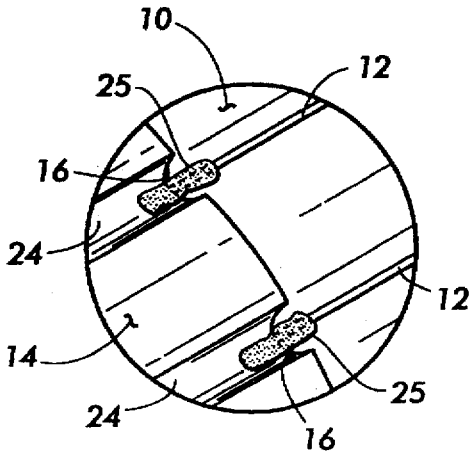
FIG. 2 shows an enlarged view of a portion of FIG. 1.

FIG. 2 shows an exploded view of the interconnect disk 14 that more shows the different layers of the interconnect disk 14 and how the interconnect through holes 20 are connected to the channels coated with the conductive coating 24 by a series of interconnect lines 18. The interconnect disk 14 is comprised of a top insulative layer 26, a conductive layer 27, a middle insulative layer 28, another conductive layer 29 and a bottom insulative layer 30. The interconnect through holes 20 go through all three insulative layers 26, 28, 30 as do the channels 16. However, the interconnect lines 18 are distributed between the two conductive layers 27, 29. One-half of the interconnect lines 18 are sandwiched between the top insulative layer 26 and the middle insulative layer 28 while the other half of the interconnect lines 18 are sandwiched between the middle insulative layer 28 and the bottom insulative layer 30. This leaves the middle insulative layer 28 interposed between the first half of the interconnect lines 18 and the second half of the interconnect lines 18. The middle insulative layer 28 acts as an electrically insulating layer between the two groups of interconnect lines 18. Splitting up the interconnect lines 18 into two groups with an insulating layer between the allows for a much larger density of interconnect lines 18 and therefore a greater number of connections to be made on the interconnect disk 14. If the interconnect lines 18 were on one layer, instead of divided between two layers, there would not be enough space on the interconnect disk 14 to accommodate all the interconnect lines 18 and provide the requisite spacing between the interconnect lines 18 to sustain high voltages on the interconnect lines 18 without arcing or other problems on adjacent interconnect lines 18. By spreading the interconnect lines 18 across two layers with an insulating layer between them, adjacent interconnect lines 18 have been separated and insulated from each other thus removing problems of arcing between them and enabling a high density of high voltage lines to be tightly packed into the small size of the interconnect disk 14.

It should be noted this invention is not limited to two conductive layers 27, 29 and three insulative layers 26, 28, 30. Any number of conductive layers may be used so long as there are sufficient insulative layers to separate the conductive layers from each other.

Figure 3:
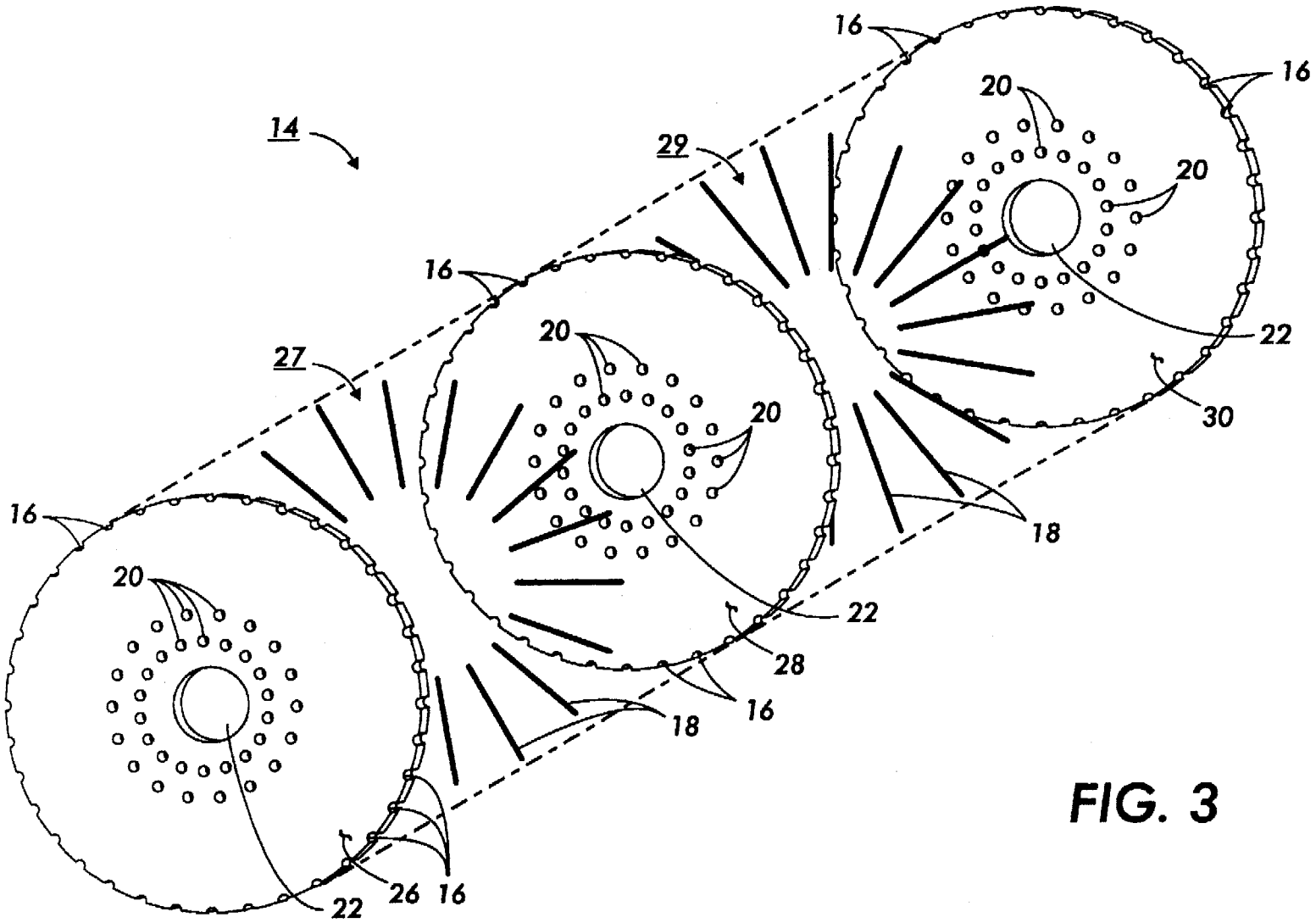
FIG. 3 shows an exploded view of the interconnect disk shown in FIG. 1.
Figure 4:
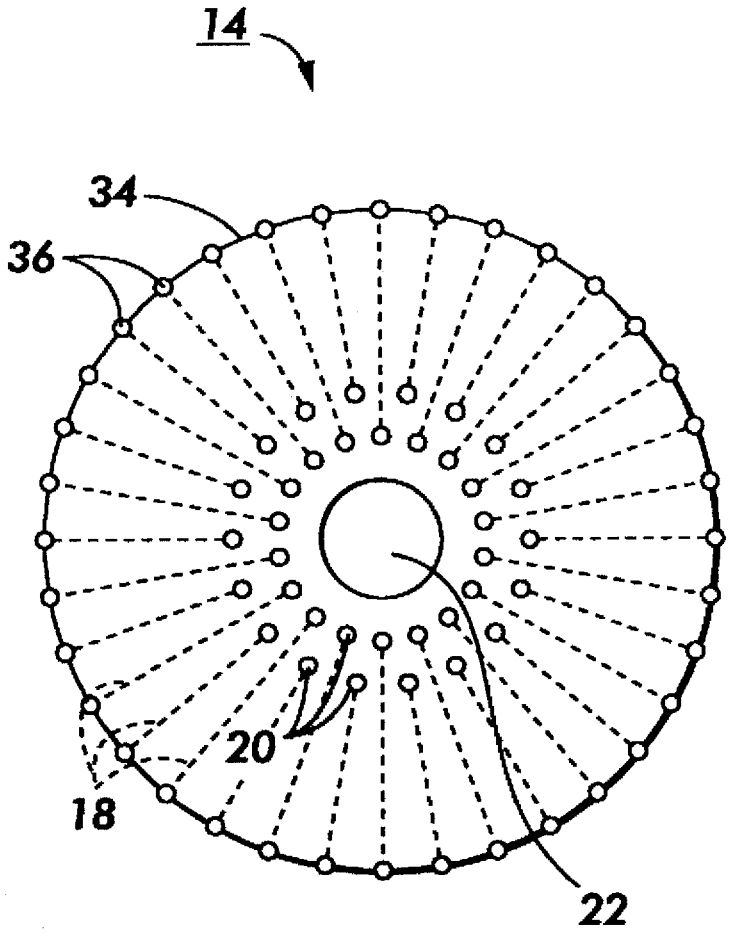
FIG. 4 shows a top view of the interconnect disk shown in FIG. 1 prior to separation from a printed wiring board.

FIG. 3 shows a top view of the interconnect disk 14 before it is separated from a printed wiring board 32. The printed wiring board 32 is fabricated using standard fabrication techniques for multi-layer boards. The interconnect through holes 20 are fabricated including the conductive coating 24 inside the interconnect through holes 20. The channels 16 are fabricated as a series of through holes 36 around the perimeter of the interconnect disk 14. When the interconnect disk 14 is removed from the printed wiring board 32 it will be separated from the printed wiring board 32 along saw line 34. Saw line 34 comprises the circumference of interconnect disk 14 and cuts through the through holes 36 that will create channels 16 around the perimeter of the interconnect disk 14.

We claim:

1. A low profile interconnect disk comprising:

A) an N number of disks made from an insulating material where N is equal to or greater than 3, each of said disks having a center, a center hole, and a circumferential edge, B) each disk having a multiplicity of conductive through-holes and an equal number of conductive grooves wherein each conductive through-hole has a corresponding conductive groove, said conductive through-holes being arranged around and spaced from the center hole, said conductive grooves being arranged on the circumferential edge, and said conductive through-holes and grooves on each disk being further arranged such that they align with said multiplicity of conductive through-holes and grooves on other said disks, C) a number N−1 of conductive layers having a multiplicity of conductive lines, the total number of conductive lines on all said N−1 conductive layers being equal to the number of conductive grooves, wherein each line of said multiplicity of conductive lines on each conductive layer is used to connect one of said conductive grooves with its corresponding one of said conductive through-holes, the multiplicity of conductive lines on all N−1 of said disks further being arranged such that each conductive groove is connected only with it's corresponding one of said conductive through-holes, and, D) said conductive layers being interposed between said disks such that each conductive layer is separated from each other conductive layer by a single one of said disks.

2. The low profile interconnect disk of claim 1 wherein said conductive layers are plated onto said disks.

3. The low profile interconnect disk of claim 1 wherein said lines of each conductive layer connect only non-adjacent ones of said conductive grooves with their respective ones of said conductive through-holes.

4. A low profile interconnect disk comprising:

A) an N number of disks made from an insulating material where N is equal to or greater than 3, each of said disks having a center, a center hole, and a circumferential edge, B) each disk having a multiplicity of conductive through-holes and an equal number of conductive grooves wherein each conductive through-hole has a corresponding conductive groove, said conductive through-holes being arranged around and spaced from the center hole, said conductive grooves being arranged on the circumferential edge, and said conductive through-holes and grooves on each disk being further arranged such that they align with said multiplicity of conductive through-holes and grooves on other said disks, C) a number N−1 of conductive layers having a multiplicity of conductive lines, the total number of conductive lines on all said N−1 conductive layers being less than the number of conductive grooves, wherein each line of said multiplicity of conductive lines on each conductive layer is used to connect only one of said conductive grooves with its corresponding one of said conductive through-holes, the multiplicity of conductive lines on all N−1 of said disks further being arranged such that each conductive groove is connected only with it's one of said corresponding conductive through-holes, and some of said conductive through-grooves are left unconnected, and, D) said conductive layers being interposed between said disks such that each conductive layer is separated from each other conductive layer by a single one of said disks.

5. The low profile interconnect disk of claim 4 further comprising that said conductive layers are plated onto said disks.

6. The low profile interconnect disk of claim 4 wherein said lines of each conductive layer connect only non-adjacent ones of said conductive grooves with their respective ones of said conductive through-holes.

* * * * *